US006102227A

United States Patent [19]

Cochrane

[11] Patent Number: 6,102,227

[45] Date of Patent: Aug. 15, 2000

[54] SNAP-ON CAP WITH TWIST ON/OFF RECLOSURE LID

[76] Inventor: Benjamin A. Cochrane, P.O. Box 835, Danville, Calif. 94526

[21] Appl. No.: 08/954,237

[22] Filed: Oct. 20, 1997

[51] Int. Cl.[7] ..... B65D 39/00

[52] U.S. Cl. ..... 215/256; 215/318; 215/44

[58] Field of Search ..... 215/256, 318, 215/44

[56] References Cited

U.S. PATENT DOCUMENTS

| | | | |
|---|---|---|---|
| 4,354,609 | 10/1982 | Hidding | 215/252 |
| 4,417,666 | 11/1983 | Roberts | 215/256 |
| 4,984,701 | 1/1991 | Margaria | 215/256 |
| 5,097,974 | 3/1992 | Rozenberg | 215/256 X |
| 5,190,178 | 3/1993 | Luch | 215/256 |
| 5,197,619 | 3/1993 | Margaria | 215/256 |
| 5,207,340 | 5/1993 | Cochrane | 215/256 |

*Primary Examiner*—Stephen K. Cronin
*Attorney, Agent, or Firm*—Myers, Dawes & Andras LLP

[57] ABSTRACT

There is disclosed a press-on bottle cap which is convertible to a screw reclosure lid. The cap is formed with a circular disc having an integral, downwardly dependent circumferential skirt. The skirt has a raised helical bead on its inside wall which extends an angular increment from 270 to about 400 degrees and a raised circumferential bead located beneath the helical bead and at least one tear line defined by a circumferential band of weakened strength located between the circumferential and helical beads. A tear tab extends from the outer wall of the skirt adjacent the tear line which can be pulled by the user to sever a reclosure lid having the helical bead which can be threaded onto the neck of the bottle to seal its contents. For this purpose, the undersurface of the disc of the cap has a compressible sealing gasket which is engaged by an annular lip of the upper end of the bottle neck.

16 Claims, 4 Drawing Sheets

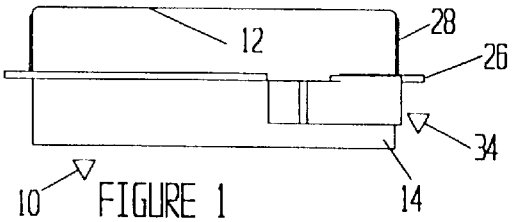
FIGURE 1
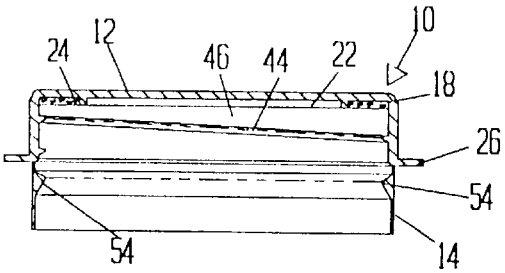
FIGURE 4
FIGURE 2
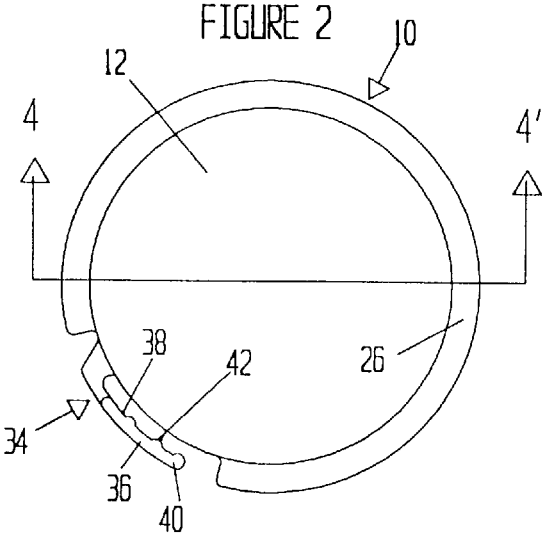
FIGURE 6
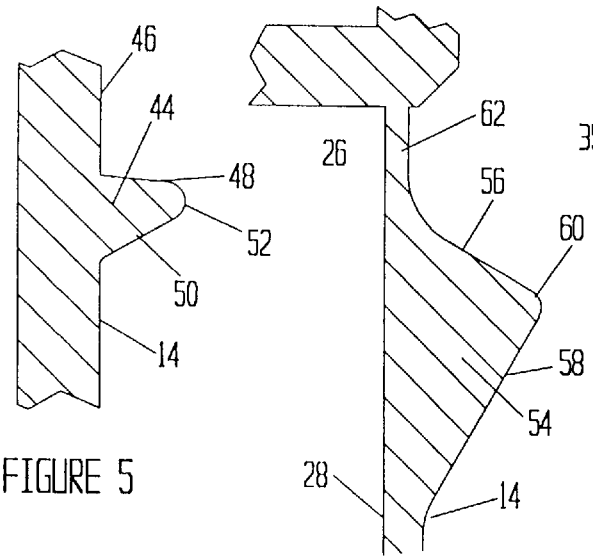
FIGURE 5
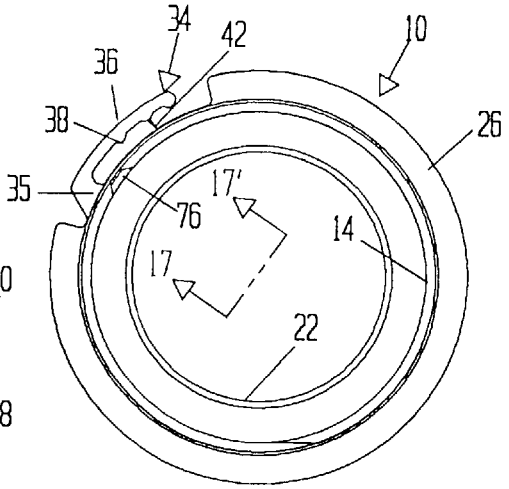
FIGURE 3

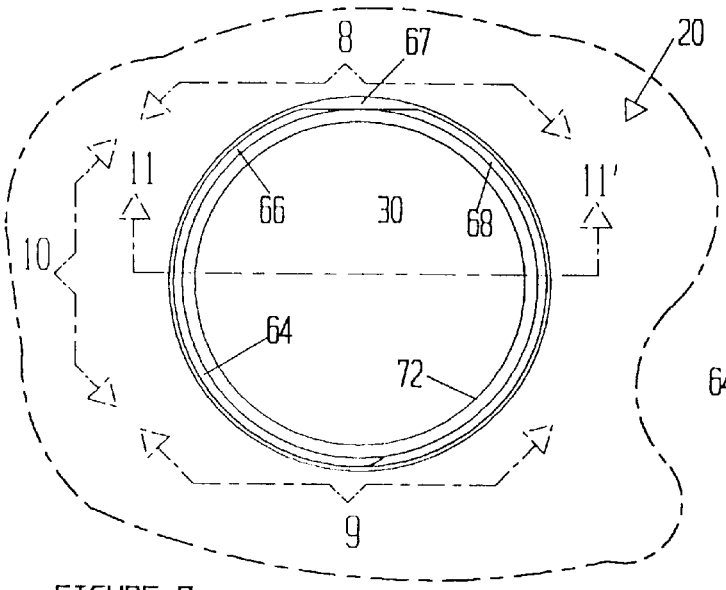
FIGURE 7
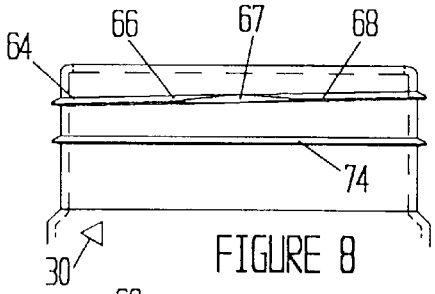
FIGURE 8
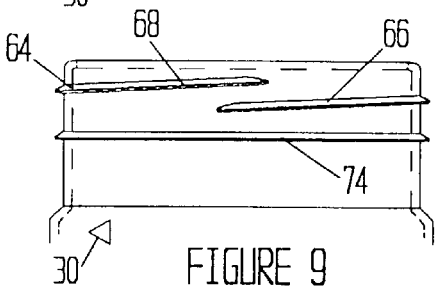
FIGURE 9
FIGURE 10
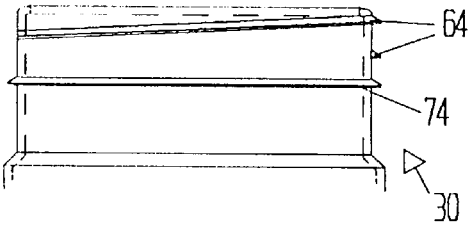
FIGURE 11
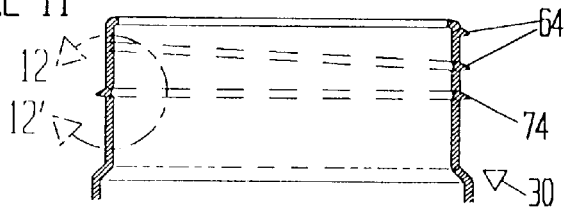
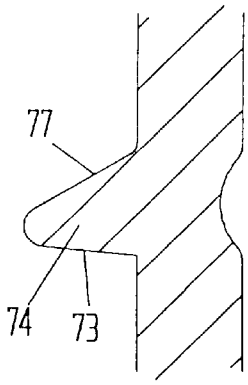
FIGURE 12

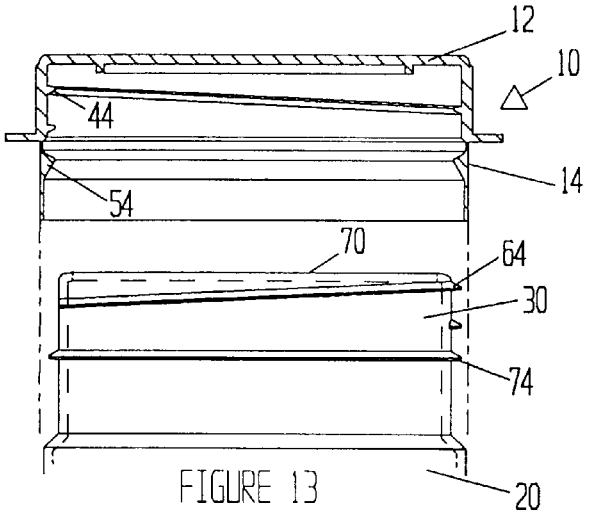
FIGURE 13
FIGURE 14
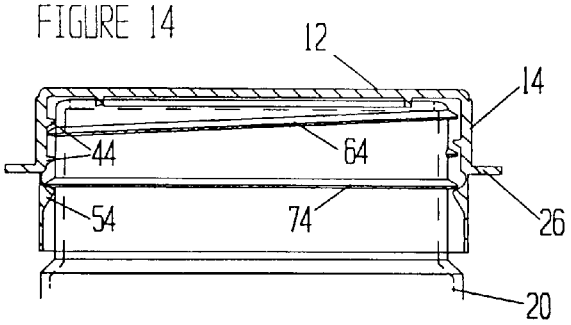
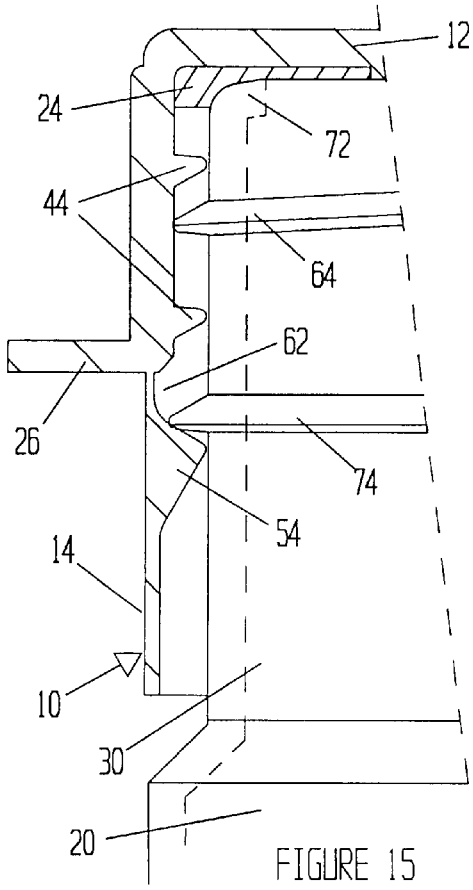
FIGURE 15

SNAP-ON CAP WITH TWIST ON/OFF RECLOSURE LID

BACKGROUND OF INVENTION

1. Field of Invention

This invention relates to a cap for plastic containers such as dairy and drink bottles and, in particular, to a snap-on cap which converts by the consumer to a twist on/off reclosure lid.

2. Brief Statement of the Prior Art

Caps for liquid containers are commonly molded of plastic and are of two basic types. One type is a twist-on, or screw, cap with a peripheral skirt having a helical thread which engages a threaded neck finish of the container and is applied by threading it onto the neck of the container. The other type is a snap-on cap which has a peripheral skirt which has one or more annular beads on its inside wall that snap into receiving grooves of the neck finish of the container when the cap is pressed onto the neck of the container. Both types of caps are rendered tamper-evident by the inclusion of a lowermost annular bead that seats into a groove of the container neck with score lines in the skirt to permit the consumer to sever the cap into a reclosure lid and a throw away tear band.

Unfortunately, there are disadvantages to each type of cap. While the snap-on cap offers the advantage of simple bottling and capping machinery, the reclosure lid which is formed when the tear band is removed by the consumer cannot be tightly sealed to the container neck. The twist-on cap forms a reclosure lid which can be twisted to compress the container neck tightly against a gasket in the lid by the consumer, however, complex capping machinery is required for the bottling operations as the containers or caps must be rotated during application of the caps.

The difficulties in sealing with snap-on caps is exacerbated by wear of the dies, shear steel and neck rings, used in blow molding of the plastic containers which result in imprecise dimensions of the critical dimensions of the neck finish.

Gaskets of various designs have also been used for the caps to improve their sealing to the containers. Foil discs have been ultrasonically and thermally bonded to bottle necks, however, their application increases manufacturing and bottling costs.

In my prior patent, U.S. Pat. No. 4,032,029, I disclosed a closure with an annular tear band and tab, and an annular lip. While this closure was a substantial improvement over the aforementioned closures, its manufacture require a split cavity mold, and it also utilized a less than ideal center corking skirt.

In my prior patents, U.S. Pat. Nos. 4,632,265 (Re. 33,764); 4,951,830; 5,207,340; and Des. 329,602 and 342,897, I disclosed press-on caps with an annular tear band and radially projecting tear tab which can be molded in a manufacturing mold having a single parting surface. In my prior patent, U.S. Pat. No. 4,819,906, I disclosed and claimed the mold useful to manufacture the caps.

All of these prior press-on caps formed a press-on reclosure lid when the consumer opened the bottle by pulling on the tear tab.

OBJECTIVES OF THE INVENTION

It is an objective of this invention to provide a press-on bottle cap.

It is also an objective of this invention to provide the press-on cap with a sealing and tamper-evident mechanism.

It is likewise an objective of this invention to provide the press-on cap with a tear tab and tear line to permit the user to sever the cap and form a reclosure lid when opening the bottle.

It is a further objective of this invention to provide a cap which forms a reclosure lid having a helical bead and gasket that can be threaded onto a bottle neck to effect sealing of the bottle contents.

It is a corollary objective of this invention to provide a bottle with a neck finish having a helical bead which is cooperative with the helical bead of the reclosure lid.

It is an additional objective of this invention to provide a press-on cap with at least one internal, circumferential bead that can be pressed onto a bottle neck having a cooperating external circumferential bead to secure the cap to the bottle neck.

It is a corollary objective of this invention to provide the circumferential beads of the cap and bottle of this invention with shapes and sizes which provide a resilient compressive force of the neck lip against the sealing gasket of the cap that is adequate to seal the contents of the bottle regardless of the relative positions of the helical beads of the bottle neck and cap.

Other and related objectives of this invention will be apparent from the following disclosure of the preferred embodiment.

BRIEF DESCRIPTION OF THE INVENTION

The invention is a press-on bottle cap which is convertible to a screw reclosure lid which is formed with a circular disc having an integral, downwardly dependent circumferential skirt. The skirt has a raised helical bead on its inside wall which extends an angular increment from 270 to about 400 degrees and a raised circumferential bead located beneath the helical bead and at least one tear line defined by a circumferential band of weakened strength located between the circumferential and helical beads. A tear tab extends from the outer wall of the skirt adjacent the tear line which can be pulled by the user to sever a reclosure lid having the helical bead which can be threaded onto the neck of the bottle to seal its contents. For this purpose, the undersurface of the disc of the cap has a compressible sealing gasket which is engaged by an annular lip of the upper end of the bottle neck.

BRIEF DESCRIPTION OF THE DRAWINGS

FIG. 1 is an elevational view of the preferred form of the cap of the invention;

FIG. 2 is a top view of the cap shown in FIG. 1;

FIG. 3 is a view of the underside view of the cap shown in FIG. 1;

FIG. 4 is a sectional view along line 4—4' of FIG. 2;

FIG. 5 is an enlarged sectional view of the upper helical bead of the cap shown in FIG. 1;

FIG. 6 is an enlarged sectional view of the lower circumferential bead of the cap shown in FIG. 1;

FIG. 7 is a top view of the neck of the container used with the cap shown in FIG. 1;

FIG. 8 is a view along line 8 of FIG. 7;

FIG. 9 is a view along line 9 of FIG. 7;

FIG. 10 is a view along line 10 of FIG. 7;

FIG. 11 is a view along section line 11—11' of FIG. 7;

FIG. 12 is an enlarged view of the lower circumferential bead of the neck shown in FIGS. 7–11;

FIG. 13 is a view of the cap, in sectional view, as it is applied to a bottle neck;

FIG. 14 is a sectional view of the cap on a bottle neck;

FIG. 15 is an enlarged view of the area within line 15—15' of FIG. 14;

DESCRIPTION OF PREFERRED EMBODIMENTS

Figure 16:
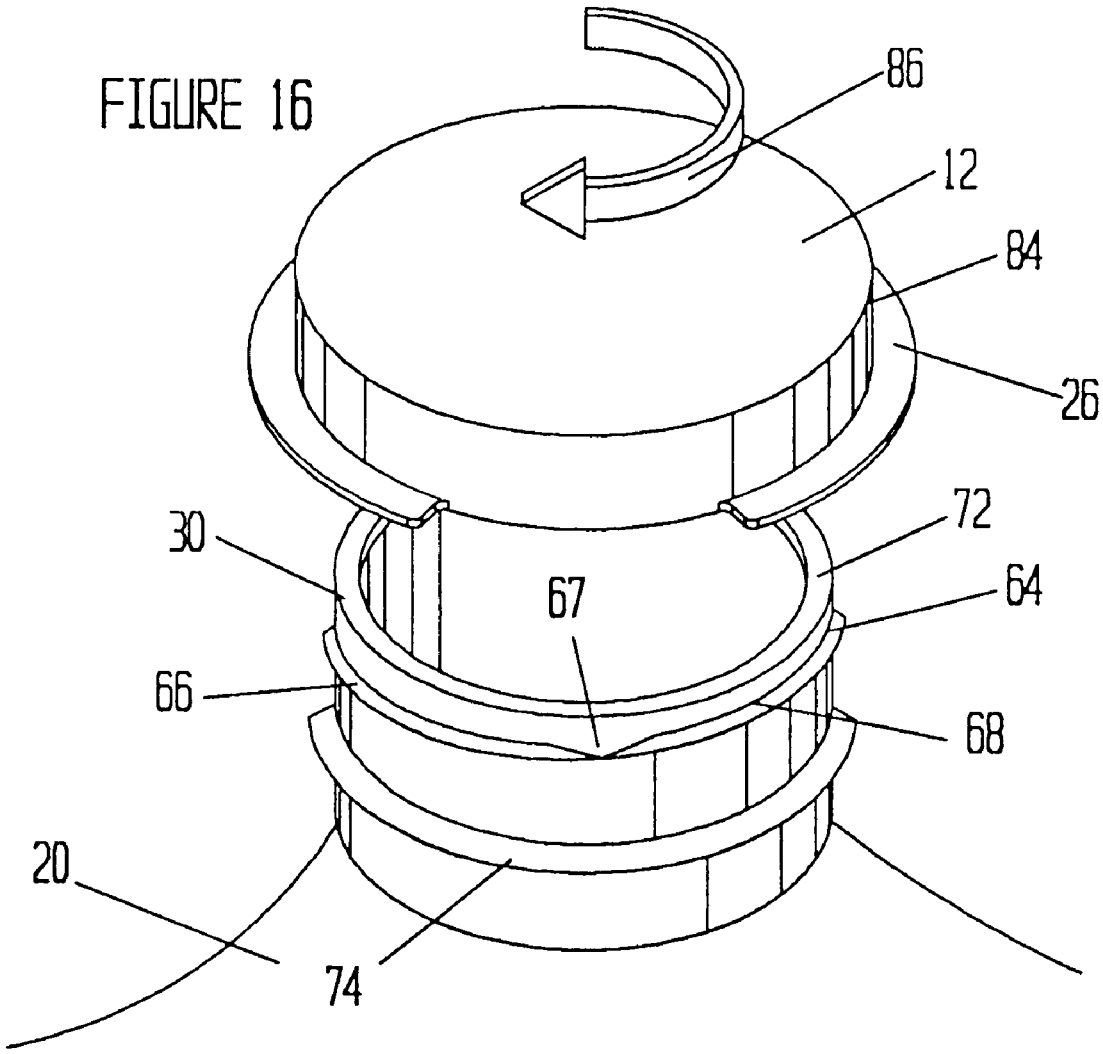
FIG. 16 is a perspective view of the application of the reclosure lid of the invention onto the neck of a bottle.

Referring to FIGS. 1–4, the cap of the invention will be described. The cap 10 is formed from a resilient and moderately flexible plastic substance that will deform slightly to snap onto a container. Exemplary plastic materials which may be employed include polyethylene, polystyrene, polyvinyl chloride, polyacrylates, polyamides, polypropylene, etc. The preferred plastic is low density polyethylene.

The external appearance of the cap 10 of the invention is the same as that described in my earlier patents, such as U.S. Pat. No. 5,207,340. The cap 10 has a top, circular disc 12 with an integral, downwardly dependent cylindrical skirt 14. The thickness of the skirt 14 is not critical to the practice of this invention as long as the cap 10 is sufficiently resilient to allow the internal beads on the skirt 14 to snap over the annular beads on the container neck without tearing the closure or container. Generally, however, the skirt thickness is governed by economics with the thinnest walled functional closure being preferred. Usually, the skirt 14 will have a thickness ranging from 0.3 to 1.5 millimeters and more usually from 0.5 to 1.2 millimeters.

The undersurface 16 of the disc 12 has an annular well 18 formed on its undersurface by a circular rim 22 of lesser diameter than, and concentric with, the skirt 14. A compressible sealing gasket 24 is seated in the annular well 18. Preferably the gasket is formed of suitable compressible plastic such as polyethylene, polyurethane, polystyrene, etc. A suitable material is a thermoplastic hot meld having a high elasticity. An example of a commercially available material is product S-314-434A from Bostik which has about 520 percent elongation at break point and a tensile strength of about 140 psi. This material can be applied in a foamed or unfoamed state. Other plastic foams can be used and are preferably of low density, e.g., about 0.5 to about 2 pounds per cubic foot. The gasket 24 is relatively thin, e.g., from about 0.1 to about 0.25 inch, preferably from about 0.1 to about 0.125 inch in thickness. The gasket 24 is formed of plastics which are resistant to liquid permeation, and when used in a foamed state, the foams are formed of closed cells, to be impermeable to liquids. The gasket 24 can be formed during the formation of the closure, and for this purpose, a polyolefin liquid resin, which cures to a polyolefin foam can be injected into the mold cavity as a preliminary step to the injection molding of the closures. Once the polyolefin foam is injected and the foam gasket 24 is formed, the injection molding of the cap proceeds with the formation of a cap having a firmly bonded gasket 24 on its undersurface 16. The gasket 24 can be subsequently formed or bonded to the undersurface of cap 10, either by bonding a preformed and precut gasket 24 or by applying the liquid plastic onto the previously formed cap. This is the preferred application with the hot melt gasket material previously described.

The skirt 14 has an integral annular lip 26 on its outer surface 28 which is located at an intermediate, approximately at the mid-point, of the height of the skirt 14. This lip 26 preferably has a discontinuity 32 for an angular increment from 5 to about 30 degrees, providing a location for the tear tab 34. The tear tab 34 is integral with, and projects from, the skirt 14 a distance approximately the width of the lip 26 and has a trailing leg 36 which has an outer radius approximately equal to the outer radius of the skirt 14. The inside surface 38 of the tear tab 34 preferably has a plurality of transverse ribs to enhance gripping with one's fingers. Preferably, the end 40 of the tear tab 34 has a small projection 42 which is integral with the tab and with the skirt 14, securing the tab against accidental dislodgement. As described in the above-identified patents, this external construction of the cap 10 provides a cap which can be readily molded without use of split cavity injection molds and which readily rolls down feeder chutes in bottle capping machinery.

The cap 10 of this invention has a raised helical bead 44 on the inside wall 46 of the skirt 14 extending through an angular increment from 270 to about 400 degrees, preferably about 360 degrees. The bead 44 has a generally triangular cross section with a substantially flat or horizontal top surface 48, a tapered or bevelled undersurface 50 and a rounded edge 52. The shape and size of bead 44 is important for the proper functioning of the cap 10, as the cap is to be pressed onto the bottle neck requiring the bevelled undersurface to permit the bead to snap past the retaining bead of the bottle neck, described hereinafter. Since the reclosure lid formed from the cap functions as a screw lid which permits compression of the gasket 24 of the lid, it is also important that the upper surface 48 of the bead 44 be horizontal to provide maximum resistance against slipping over the helical thread bead of the bottle neck, described hereinafter.

The cap 10 also has a raised circumferential bead 54 located beneath the helical beam 44 on the inside wall 46 of the skirt 14. This bead 54 functions as the manufacturer seal and the tamper resistant mechanism in conjunction with the sealing gasket 24 and with a mating circumferential bead on the bottle neck. As shown in FIG. 6, the circumferential bead 54 has a triangular cross section with a bevelled upper surface 56, a more acutely bevelled lower surface 58 and a rounded edge 60. The shape and size of bead 54 is important to the proper function of the cap 10, as will be described in reference to FIG. 15.

The cap 10 has at least one tear line defined by a circumferential band 62 of weakened strength in the skirt 14 which is located between the lower circumferential bead 54 and upper, helical bead 44. This is shown in FIG. 6 as a reduction in the wall thickness of the skirt in a circumferential band 62 immediately above the lower, circumferential bead and below lip 26. Alternatively, one or more score lines could be formed in the skirt wall at the location of the band 62.

Figure 17:
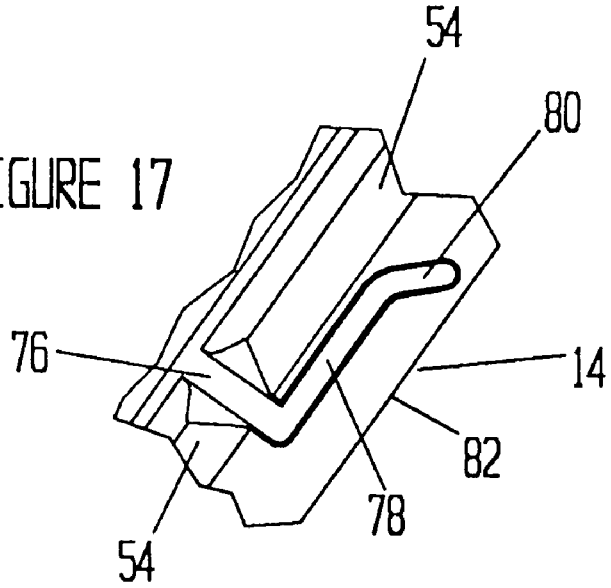
FIG. 17 is a view along line 17—17' of FIG. 3.

In the preferred embodiment, the tear tab severs the lower portion 15 (see FIG. 1) of the skirt 14, permitting its removal from the bottle. The shape of the weakened wall band 76 is shown in greater detail in FIG. 17. The axial, weakened wall band 76 on the inside wall 46 of the skirt 14 traverses the lower circumferential bead 54. The axial, weakened wall band 76 is located immediately opposite the trailing edge of the radial projection 35 of the tear tab 34; see FIG. 3. Preferably, the axial weakened wall band 76 is contiguous with a short, peripheral, weakened wall band 78 that terminates in an inclined leg 80 that extends toward the bottom edge 82 of the cap, but ends approximately two millimeters short of the edge 82. This structure provides a tear line for severing the lower band 15 without weakening the cap such that it would be prone to splitting when it is pressed onto a bottle neck at the bottling plant.

Referring now to FIGS. 7–12, the bottle neck 30 which is used with the cap of the invention will be described. The bottle 20 and cap 10 of the invention are intended for the packaging of liquids such as non-carbonated drinks and milk, lubricating oils, etc.

The bottle 20 is a conventional blow molded plastic container having a liquid capacity from about one pint to five gallons, typically a quart or one gallon container. The bottle 20 has a neck 30 which typically has a diameter from 28 to about 85 millimeters. The neck 30 which is useful with the caps of this invention includes an upper helical bead 64 and a lower circumferential bead 74. The upper bead 64 and lower bead 74 are located at the proper axial spacing on the bottle neck 30 to cooperatively engage the upper helical bead 44 and lower circumferential bead 54 of the cap 10. The upper helical bead 64 on the bottle neck 30 has the same pitch as that of the upper helical bead 44 of the cap 10, thereby providing for threaded engagement of the bottle neck 30 with the reclosure lid formed from the cap 10.

Preferably, the upper helical bead 64 of the bottle neck 30 is discontinuous, thereby forming two, coextensive, helical segments 66 and 68. This is shown in FIGS. 7 and 8 as a discontinuity 67 in the bead 64 which extends for an angular increment of from 5 to about 20 degrees. The relieving of the helical bead 64 in this fashion provides for ease of seating of the cap 10 during the press-on application, as described hereinafter with reference to FIG. 15.

Referring now to FIGS. 13–15, the application of the cap 10 onto the bottle neck 30 of the invention will be described. The cap 10 is placed over the open end 70 of the bottle neck 30 in the relative position as shown in FIG. 13. The capping machinery then forces the cap 10 onto the bottle neck 30, into the position shown in FIG. 14, where the lower circumferential bead 54 of the cap 10 snaps over the lower circumferential bead 74 of the bottle neck 30. As shown in greater detail in FIG. 15, the shapes and sizes of the bottle neck 30, cap 10 and beads are selected to provide a tight seal of the bottle 20. This is achieved by the inclined upper surface 56 of the lower circumferential bead 54 of the cap 10 which resiliently bears against the lower circumferential bead 74 of the neck 30 and exerts a continuous axial compressive force of the annular lip 72 of the bottle neck 30 against the sealing gasket 24, deforming the gasket 24 and effecting a tight sealing of the contents of the bottle 20.

The caps are rolled through a cap chute to the capping operation of the bottling machinery. This prevents any indexing of the rotational orientation of the cap to the bottle neck 30. Consequentially, the upper helical bead 44 of the cap 10 may not engage the upper helical bead 64 of the bottle neck 30 when the cap 10 is pressed onto the bottle neck 30. This is illustrated in FIG. 15 which shows the upper helical bead 44 positioned above and out of registration with the helical bead 64 of the bottle neck 30. Since the cap 10 and bottle 20 are formed of resilient and slightly deformable plastics, preferably of polyethylene, the upper helical beads 44 and 64 will deform to the extent necessary to permit the seating of the cap 10 and engagement of the lower circumferential beads 64 and 74 of the cap 10 and bottle neck 30. This deformation is facilitated by the discontinuity 67 in the helical bead of the bottle neck 30, as previously described. In those instances where the rotational orientation of the cap 10 on the bottle neck 30 aligns the helical beads 44 and 64 of the cap 10 and bottle neck 30, the beads snap together when the cap 10 is pressed onto the bottle 20.

The reclosure lid 84 is shown is FIG. 16 as it is applied to a bottle neck 30. The reclosure lid 84 includes the upper portion of the cap, above and including the annular lip 26. As apparent from FIG. 4, the upper, helical bead 44 extends about the inside wall 46 of the reclosure lid 84 and this bead threadably engages the upper helical bead 64 (helical segments 66 and 68) on the bottle neck 30. The application of the reclosure lid with a counterclockwise rotation, shown by arrowhead line 86 will tightly seal the contents of the bottle 20 by compressing the annular lip 72 of the bottle neck 30 against the seal gasket 24, and secure the reclosure lid 84 against dislodgement from the bottle 20.

The invention has been described to the illustrated and presently preferred embodiments. It is not intended that the invention be unduly limited by this disclosure of preferred embodiments. Instead, it is intended that the invention be defined by the means, and their obvious equivalents, set forth in the following claims.

What is claimed is:

1. A press-on bottle cap which is convertible to a screw reclosure lid which comprises:

a. a circular disc having a flat, planar, unrelieved top surface with an integral, downwardly dependent circumferential skirt;

b. an annular seal on the undersurface of said disc;

c. a raised helical bead on the inside wall of said skirt extending through an angular increment no less than 270 and no greater than 400 degrees with a centrally located discontinuity no less than 5 and no greater than 20 degrees;

d. a raised circumferential bead located beneath said helical bead on the inside wall of said skirt;

e. at least one tear line defined by a circumferential area of weakened strength in said skirt located between said circumferential and helical beads; and f. a tear tab extending from the outer wall of said skirt adjacent said tear line.

2. The press-on bottle cap of claim 1 including an annular lip integral with said body, of a greater diameter than said skirt and extending exteriorly about said skirt, and located beneath said top disc, intermediate the height of said skirt.

3. The press-on bottle cap of claim 1 including a tab having a leg portion dependent from said skirt beneath said score line and projecting outwardly from said skirt, and an arcuate trailing portion having a diameter no greater than the diameter of said annular lip, and located immediately beneath said tear line.

4. The press-on bottle cap of claim 1 including an axial, weakened tear band in said skirt, extending from proximate said tear tab through said lower, circumferential bead and terminating adjacent the lower edge of said cap, thereby permitting severing of the lower portion of said cap by said tear band.

5. The press-on bottle cap of claim 1 wherein the trailing portion of said tab has a width greater than the width of said tear band.

6. The closure of claim 1 wherein said annular bead has a triangular cross section.

7. The closure of claim 1 wherein said annular bead extends through an angular increment of 360 degrees.

8. The press-on bottle cap of claim 1 wherein said sealing means comprises a cylindrical skirt downwardly dependent on the undersurface of said disc and concentrically within said peripheral skirt forming an annular well.

9. The press-on bottle cap of claim 8 wherein said inner skirt is inwardly spaced from said peripheral skirt by an annulus of a width slightly less than the width of neck finish of said bottle and is of a significantly lesser thickness than said peripheral skirt to permit its inward deflection by the neck of said bottle.

10. The closure of claim 8 wherein said sealing means comprise a sealing gasket in said annular well on the undersurface of said disc.

11. The combination of the closure of claim 1 with a bottle having a neck with a neck finish comprising a helical bead about its outer wall which engages said helical bead on the inside wall of said skirt.

12. The combination of claim 11 wherein said sealing of said closure comprises a sealing gasket on the undersurface of said disc.

13. The combination of claim 12 wherein said gasket is bonded to the upper edge of the neck of said bottle.

14. The combination of claim 11 wherein said bottle neck has a circumferential bead located axially beneath said helical bead and wherein said raised circumferential bead on the inside wall of the skirt of said cap is aligned with and received against said circumferential bead on said bottle neck.

15. The combination of claim 14 wherein said closure has upper and lower, spaced-apart score lines which are axially between said helical and circumferential beads to define a tear band therebetween.

16. The combination of claim 15 wherein the lowermost portion of said skirt, beneath said lower score line is permanently bonded to the neck of said bottle.

* * * * *